US012135170B2

(12) United States Patent
Hong et al.

(10) Patent No.: US 12,135,170 B2
(45) Date of Patent: Nov. 5, 2024

(54) HEAT EXCHANGER AND HEAT EXCHANGING SYSTEM COMPRISING THE SAME

(71) Applicant: SAMSUNG ELECTRONICS CO., LTD., Suwon-si (KR)

(72) Inventors: Wooram Hong, Suwon-si (KR); Hyun Do Choi, Yongin-si (KR); Dal Heo, Yongin-si (KR); Youngchun Kwon, Yongin-si (KR); Hyukju Kwon, Uiwang-si (KR); Gahee Kim, Yongin-si (KR); Bosung Kim, Suwon-si (KR); Jeonghun Kim, Suwon-si (KR); Jin Woo Kim, Suwon-si (KR); Min Sik Park, Hwaseong-si (KR); Youngjin Park, Seoul (KR); Hyungtae Seo, Suwon-si (KR); Won Seok Oh, Gunsan-si (KR); Dongseon Lee, Suwon-si (KR); Sangyoon Lee, Suwon-si (KR); Jaejun Chang, Gwacheon-si (KR); Jun-Won Jang, Seoul (KR); Hyunjeong Jeon, Suwon-si (KR); Joon-Kee Cho, Yongin-si (KR); Byung-Kwon Choi, Seongnam-si (KR); Won Je Choi, Suwon-si (KR); Younsuk Choi, Seongnam-si (KR); Taesin Ha, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/888,213

(22) Filed: Aug. 15, 2022

(65) Prior Publication Data

US 2023/0184490 A1 Jun. 15, 2023

(30) Foreign Application Priority Data

Dec. 13, 2021 (KR) ..... 10-2021-0177794

(51) Int. Cl.
*F28D 9/00* (2006.01)

(52) U.S. Cl.
CPC ..... *F28D 9/005* (2013.01); *F28D 9/0093* (2013.01)

(58) Field of Classification Search
CPC ..... F28D 9/0012; F28D 1/0417; F28D 20/02; F28D 9/00; F28D 15/00; F28D 9/0093;
(Continued)

(56) References Cited

U.S. PATENT DOCUMENTS 2,538,957 A 1/1951 Askevold et al.
3,415,316 A 12/1968 Burne et al.
(Continued)

FOREIGN PATENT DOCUMENTS

CZ 2021356 A3 * 9/2022
DE 3009850 A1 9/1981
(Continued)

OTHER PUBLICATIONS

LaValle, "Planning Algorithms", Cambridge University Press, 2006, (1023 total pages).
(Continued)

*Primary Examiner* — Harry E Arant
(74) *Attorney, Agent, or Firm* — Sughrue Mion, PLLC

(57) ABSTRACT

A heat exchanger is provided. The heat exchanger includes a target area that is a target for heat exchange; and a flow path structure. The flow path structure includes at least one inlet; at least one outlet; a first flow path connected to each of the at least one inlet and the at least one outlet, and extending along a first side of the target area; and a second
(Continued)

flow path connected to each of the at least one inlet and the at least one outlet, and extending along a second side, different from the first side, of the target area.

20 Claims, 15 Drawing Sheets

(58) Field of Classification Search
CPC .. F28D 15/02; F28D 9/005; F28D 2021/0022; F28F 7/02
See application file for complete search history.

(56) References Cited

U.S. PATENT DOCUMENTS

| | | | | |
|---|---|---|---|---|
| 3,513,907 | A | 5/1970 | Hughes | |
| 3,791,326 | A | 2/1974 | Schwarz | |
| 3,907,683 | A | 9/1975 | Gilmont | |
| 4,301,658 | A | 11/1981 | Reed | |
| 5,103,899 | A * | 4/1992 | Kalina | F28D 19/00 165/111 |
| 6,119,769 | A * | 9/2000 | Yu | F28F 1/405 165/184 |
| 6,306,658 | B1 | 10/2001 | Turner et al. | |
| 6,905,656 | B1 | 6/2005 | Ladlow et al. | |
| 7,111,666 | B2 | 9/2006 | Zeighami et al. | |
| 7,431,071 | B2 | 10/2008 | Wenger | |
| 7,556,966 | B2 | 7/2009 | Van Erden et al. | |
| 7,833,327 | B2 | 11/2010 | Hirai et al. | |
| 10,337,808 | B2 | 7/2019 | Naitou et al. | |
| 10,605,541 | B1 | 3/2020 | Zheng et al. | |
| 10,955,202 | B2 | 3/2021 | Azar et al. | |
| 2001/0015059 | A1* | 8/2001 | Fetescu | F01K 23/106 60/772 |
| 2005/0128705 | A1 | 6/2005 | Chu et al. | |
| 2005/0211418 | A1 | 9/2005 | Kenny et al. | |
| 2009/0266105 | A1 | 10/2009 | Viklund et al. | |
| 2014/0138058 | A1* | 5/2014 | Hyde | F28D 15/00 165/104.21 |
| 2016/0129417 | A1 | 5/2016 | Aimone et al. | |
| 2017/0198979 | A1* | 7/2017 | St. Rock | F28F 7/02 |
| 2017/0328651 | A1 | 11/2017 | Rozga et al. | |
| 2018/0017297 | A1* | 1/2018 | Arino | F28F 9/0251 |
| 2019/0334185 | A1 | 10/2019 | Lototskyy et al. | |
| 2020/0049382 | A1* | 2/2020 | Kozasa | F25B 39/028 |
| 2021/0199383 | A1* | 7/2021 | Armstrong | F28D 7/1669 |

FOREIGN PATENT DOCUMENTS

| | | | |
|---|---|---|---|
| DE | 3145699 | A1 | 6/1983 |
| KR | 10-2007-0115094 | A | 12/2007 |
| KR | 10-2008-0004852 | A | 1/2008 |
| KR | 10-2011-0002139 | A | 1/2011 |
| KR | 10-1372096 | B1 | 3/2014 |
| KR | 10-1462176 | B1 | 11/2014 |
| KR | 10-2016-0118653 | A | 10/2016 |
| KR | 10-2017-0037187 | A | 4/2017 |
| KR | 10-2017-0115993 | A | 10/2017 |
| KR | 10-2021-0076689 | A | 6/2021 |

OTHER PUBLICATIONS

Global Market Insights, Inc., "Heat Exchangers Market to Hit $13 Billion by 2025: Global Market Insights, Inc.", Mar. 19, 2019, https://www.gminsights.com/industry-analysis/heat-exchanger-market, (4 total pages).

"Heat Exchanger Market Size, Share & Trends Analysis Report by Product (Plate & Frame (Brazed, Gasketed, Welded), Shell & Tube, Air Cooled), by End Use (Chemical, Power Generation), by Region, and Segment Forecasts, 2021-2028", Jun. 2020, GVR-4-68038-718-6, (7 total pages).

Extended European Search Report dated Mar. 31, 2023, issued by European Patent Office for European Application No. 22192378.2.

Office Action issued Jan. 10, 2024 by the European Patent Office in European Application No. 22 192 378.2.

* cited by examiner

HEAT EXCHANGER AND HEAT EXCHANGING SYSTEM COMPRISING THE SAME

CROSS-REFERENCE TO THE RELATED APPLICATION

This application claims priority from Korean Patent Application No. 10-2021-0177794, filed on Dec. 13, 2021, in the Korean Intellectual Property Office, the disclosure of which is incorporated herein by reference in its entirety.

BACKGROUND

1. Field

Methods and apparatuses consistent with example embodiments of the present disclosure relate to a heat exchanger and a heat exchanging system including the same.

2. Description of the Related Art

A heat exchanger allowing a heat exchange between a target and fluid is being developed. For example, as a series-type condensing device connected in series to a reactor in which a target to be condensed is heated, a condensing device having an area in which the target is collected and condensed and a cooling flow path area surrounding the area is developed. As another example, a parallel-type condensing device is developed that induces condensation inside a reactor by directly cooling a portion of the reactor.

SUMMARY

According to embodiments of the present disclosure, A heat exchanger is provided. The heat exchanger includes a target area that is a target for heat exchange; and a flow path structure. The flow path structure includes at least one inlet; at least one outlet; a first flow path connected to each of the at least one inlet and the at least one outlet, and extending along a first side of the target area; and a second flow path connected to each of the at least one inlet and the at least one outlet, and extending along a second side, different from the first side, of the target area.

According to one or more embodiments of the present disclosure, the at least one inlet is a single inlet and the at least one outlet is a single outlet.

According to one or more embodiments of the present disclosure, a direction in which the first flow path is configured to guide a first portion of a fluid is opposite, with respect to the target area, to a direction in which the second flow path is configured to guide a second portion of the fluid.

According to one or more embodiments of the present disclosure, the first flow path and the second flow path are not directly connected to each other.

According to one or more embodiments of the present disclosure, each of the first flow path and the second flow path is inclined with respect to the target area.

According to one or more embodiments of the present disclosure, the heat exchanger further includes a thermal body including the target area, wherein the first flow path and the second flow path are formed in the thermal body.

According to one or more embodiments of the present disclosure, a portion of the first flow path that extends along the first side of the target area is symmetrical with respect to a portion of the second flow path that extends along the second side of the target area.

According to one or more embodiments of the present disclosure, the first flow path forms a first flow stream of a fluid from the at least one inlet to the at least one outlet, and the second flow path forms a second flow stream of the fluid from the at least one inlet to the at least one outlet.

According to one or more embodiments of the present disclosure, the heat exchanger further includes a thermal body including the target area, wherein the target area includes a plurality of channels arranged in the thermal body in a circumferential direction of the thermal body, each of the plurality of channels extending in a height direction of the thermal body that is perpendicular to the circumferential direction.

According to one or more embodiments of the present disclosure, the heat exchanger further includes a thermal body including the target area, wherein the thermal body includes at least one inlet port including the at least one inlet and at least one outlet port including the at least one outlet.

According to one or more embodiments of the present disclosure, the at least one inlet port is within a first portion of the thermal body, and the at least one outlet port is within a second portion of the thermal body that is offset from the first portion in a height direction of the thermal body.

According to one or more embodiments of the present disclosure, the at least one inlet port and the at least one outlet port protrude from the thermal body.

According to one or more embodiments of the present disclosure, the first flow path and the second flow path, that are within the thermal body, bifurcate from the at least one inlet port and lead to the at least one outlet port.

According to one or more embodiments of the present disclosure, a cross-sectional area of the first flow path is different from a cross-sectional area of the second flow path.

According to one or more embodiments of the present disclosure, the heat exchanger further includes a thermal body including the target area, wherein the target area includes a plurality of channels arranged in the thermal body in a first longitudinal direction of the thermal body, each of the plurality of channels extending in a height direction of the thermal body that is perpendicular to the first longitudinal direction.

According to one or more embodiments of the present disclosure, the flow path structure further includes an entrance manifold that connects the at least one inlet to the first flow path and the second flow path; and an exit manifold that connects the first flow path and the second flow path to the at least one outlet.

According to one or more embodiments of the present disclosure, the at least one inlet includes a first inlet and a second inlet, the at least one outlet includes a first outlet and a second outlet, the first flow path is connected to the first inlet and the first outlet, and the second flow path is connected to the second inlet and the second outlet.

According to one or more embodiments of the present disclosure, the flow path structure further includes a third flow path connected to the at least one inlet and the at least one outlet and extends along a third side of the target area that is different from the first side and the second side of the target area; and a fourth flow path connected to the at least one inlet and the at least one outlet and extends along a fourth side of the target area that is different from the first side, the second side, and the third side of the target area.

According to embodiments of the present disclosure, a heat exchanging system is provided. The heat exchanging system includes a flow source; and a heat exchanger. The heat exchanger includes a target area that is a target for heat exchange; and a flow path structure. The flow path structure includes an inlet connected to the flow source; an outlet connected to the flow source; a first flow path connected to each of the inlet and the outlet, and extends along a first side of the target area, and a second flow path connected to each of the inlet and the outlet, and extends along a second side of the target area, different from the first side of the target area.

According to one or more embodiments of the present disclosure, the heat exchanger further includes a first thermal body configured to condense the target area; and a second thermal body configured to heat the target area.

BRIEF DESCRIPTION OF THE DRAWINGS

The above and/or other aspects will be more apparent by describing certain example embodiments with reference to the accompanying drawings, in which.

DETAILED DESCRIPTION

Figure 1:
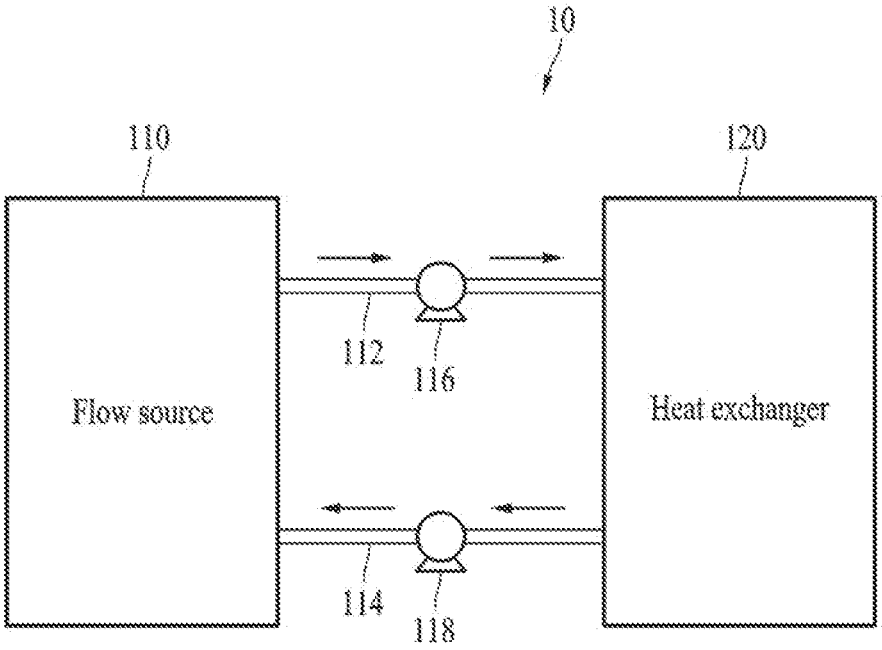
FIG. 1 illustrates a heat exchanging system according to various example embodiments.

Hereinafter, non-limiting example embodiments are described with reference to the accompanying drawings. However, various modifications may be made to the example embodiments, and the scope of present disclosure is not limited thereto or restricted thereby. It should be understood that all the modifications, equivalents, and substitutions made to the example embodiments are included in the scope of the present disclosure.

Although terms used herein are used to explain various components, the components are not limited to the terms. These terms may be used only to distinguish one component from another component. As used herein, the singular forms are intended to include the plural forms as well, unless the context clearly indicates otherwise. It should be further understood that the terms "comprises" and/or "comprising," when used in this specification, specify the presence of stated features, integers, steps, operations, elements, components or a combination thereof, but do not preclude the presence or addition of one or more other features, integers, steps, operations, elements, components, and/or groups thereof.

Unless otherwise defined herein, all terms used herein including technical or scientific terms have the same meanings as those generally understood by one of ordinary skill in the art. Terms defined in dictionaries generally used should be construed to have meanings matching with contextual meanings in the related art and are not to be construed as an ideal or excessively formal meaning unless otherwise defined herein.

Also, when describing the example embodiment with reference to the accompanying drawings, like reference numerals refer to like elements throughout and repeated explanation thereto is omitted. When it is determined that detailed description related to the known art in describing the example embodiments makes the gist of the example embodiments unnecessarily ambiguous, such detailed description is omitted.

In addition, terms, such as first, second, A, B, (a), (b), and the like, may be used herein to describe components. Each of these terms is not used to define an essence, order, or sequence of a corresponding component but used merely to distinguish the corresponding component from other component(s). It will be understood that when a component is referred to as being "connected to," "coupled to," or "accessed to" another component, the component may be directly connected or coupled to the other component or intervening components may be present.

A component including a common function with a component included in one example embodiment is described using the same name in another example embodiment. Unless the context clearly indicates otherwise, the description made in one example embodiment may apply to another example embodiment and repeated detailed description may be omitted.

FIG. 1 illustrates a heat exchanging system according to various example embodiments.

Referring to FIG. 1, a heat exchanging system 10 according to various example embodiments may be configured to exchange heat with a target area including a substance, an object, and/or a living organism for the purpose of heat exchange to change a temperature and/or energy. For example, the heat exchanging system 10 may be used for heat exchange of a condensing device configured to condense a vaporized solvent in an upper portion of a reactor in an automatic synthesis process of a substance. Here, a heat exchange process of the condensing device may also be referred to as a reflux process and may refer to a process of recondensing and recovering the vaporized solvent.

Appropriate concentration, temperature, and/or mixing state may be maintained by supplying a solvent to a mixed sample (e.g., a reagent) to induce a chemical reaction. When a target is heated to proceed with the chemical reaction, the solvent is heated above its boiling point and vaporization of the solvent may occur. When the solvent is vaporized, a level of solution decreases and a gas pressure inside a vessel may increase due to the vaporized solvent. The reflux process may maintain the solvent at a constant level by condensing and recovering the vaporized solvent, may decrease an internal pressure of the vessel, and may maintain a stable reaction state.

A reflux device may be implemented as a heat exchanger (e.g., a heat exchanger 120) configured to wrap around an upper portion of the vessel and to induce condensation through contact. The reflux device may internally form a flow path to extract heat from the inside of the vessel to outside of the vessel, and may circulate a refrigerant through the flow path. The reflux device may include a plurality of vessels and the plurality of vessels may be configured to maintain substantially the same temperature.

Meanwhile, the heat exchanging system 10 is not limited to the above example embodiment and may apply to an environment of changing a state of a target, processing the target, or proceeding with an intended change of the target by cooling and/or heating an industrial plant, a vehicle, a home appliance, a computer, an electronic chip, a sensor, a building, a living organism such as a human and an animal, and the like. For example, the heat exchanging system 10 may be used to heat and/or cool the contents in a reactor in a chemical reaction process. As another example, the heat exchanging system 10 may be used for a condensing device used for refinement through condensation and/or distillation accompanied by a phase change. In this example, when inducing a reaction of a substance through long-hour heating, the heat exchanging system 10 may apply to the reflux process of the solvent and/or a gaseous or liquid substance. As another example, the heat exchanging system 10 may apply to a residence, a cooking, a home appliance, a cooling device of a computer, a mobile phone, a wearable device, a wrist watch, and other electronic products in which heat exchange is performed, in addition to research and development, an industrial process, and/or a mass production facility in which substance synthesis is performed.

In an example embodiment, the heat exchanging system 10 may include a flow source 110 configured to generate a flow of the fluid, the heat exchanger 120 configured to exchange heat with a target area, a first supply line 112 through which the fluid is supplied from the flow source 110 to the heat exchanger 120, and a second supply line 114 through which the fluid is supplied from the heat exchanger 120 to the flow source 110. The fluid may include, for example, any fluid (e.g., water) suitable for heat exchange. In an example embodiment, the flow source 110 may be formed as a single flow source. In an example embodiment, the heat exchanging system 10 may include a first supply pump 116 positioned on the first supply line 112 and/or a second supply pump 118 positioned on the second supply line 114.

Figure 2:
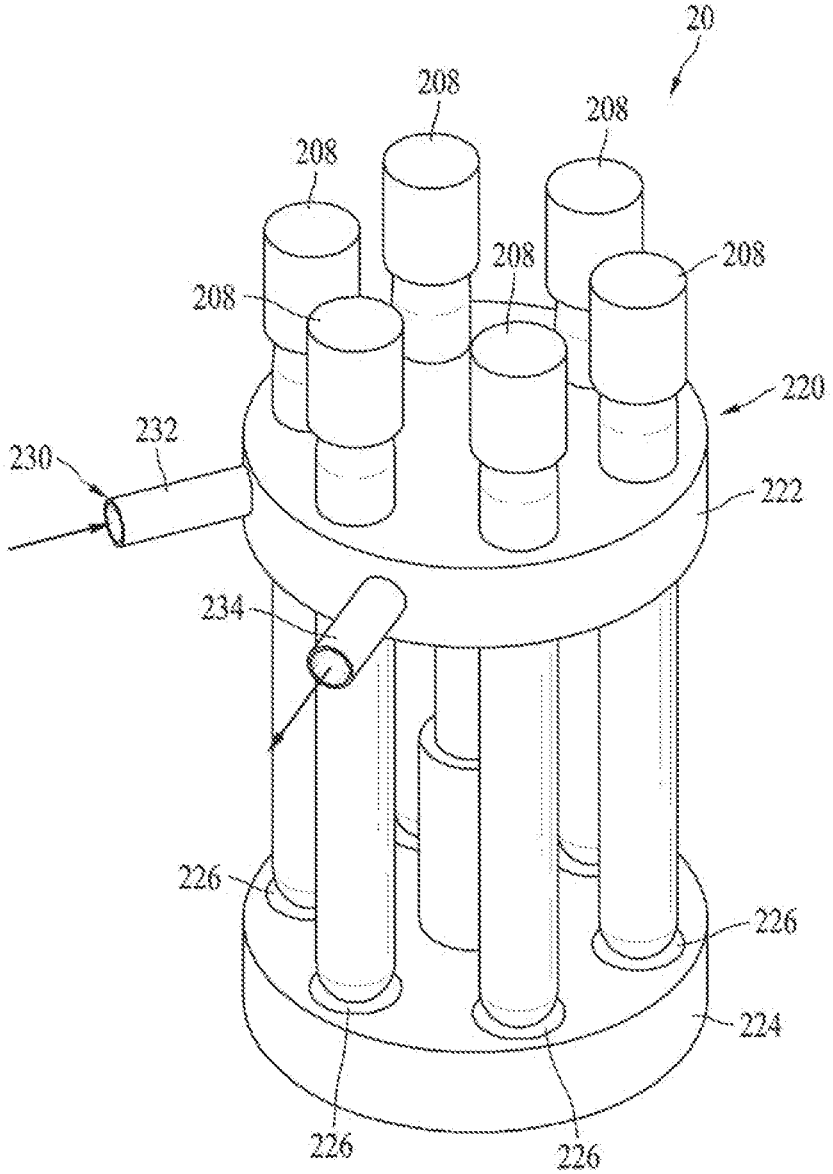
FIG. 2 illustrates a heat exchanging system according to an example embodiment.

FIG. 2 illustrates a heat exchanging system according to an example embodiment.

Referring to FIG. 2, a heat exchanging system 20 according to an example embodiment may include a plurality of vessels 208 each configured to contain at least one substance, a flow source (e.g., the flow source 110 of FIG. 1), a first thermal body 222 configured to induce condensation of the substance in the plurality of vessels 208, and a second thermal body 224 configured to heat the plurality of vessels 208. The first thermal body 222 may include a plurality of channels configured to receive the plurality of vessels 208. The second thermal body 224 may include a plurality of heating areas 226 on which the plurality of vessels 208 is positioned, respectively.

The heat exchanging system 20 may include a flow path structure 230 in which the fluid flows to surround the plurality of channels and to exchange heat with the plurality of vessels 208. The flow path structure 230 may include an inlet port 232 having an inlet configured to connect to the flow source and through which the fluid flows in, an outlet port 234 having an outlet configured to connect to the flow source and through which the fluid flows out, and at least one flow path configured to connect to the inlet and the outlet and to surround the plurality of channels.

Figure 3:
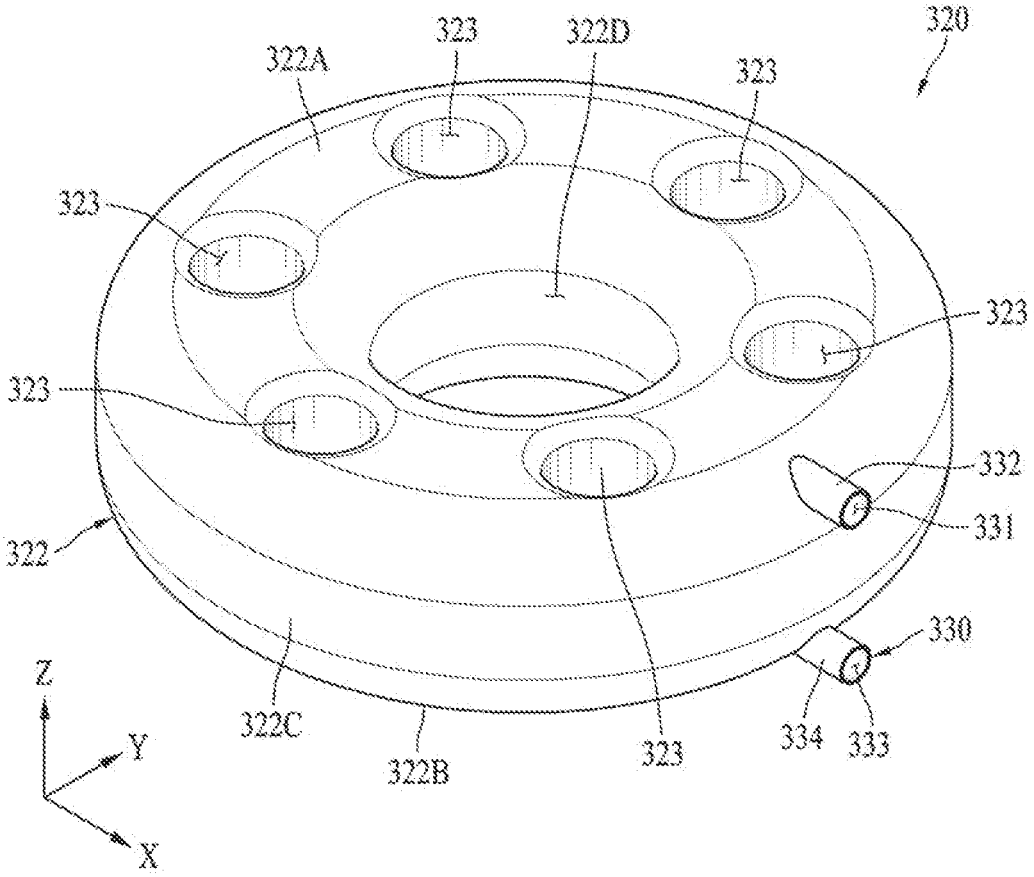
FIG. 3 is a perspective view illustrating an example of a heat exchanger according to an example embodiment.
Figure 4:
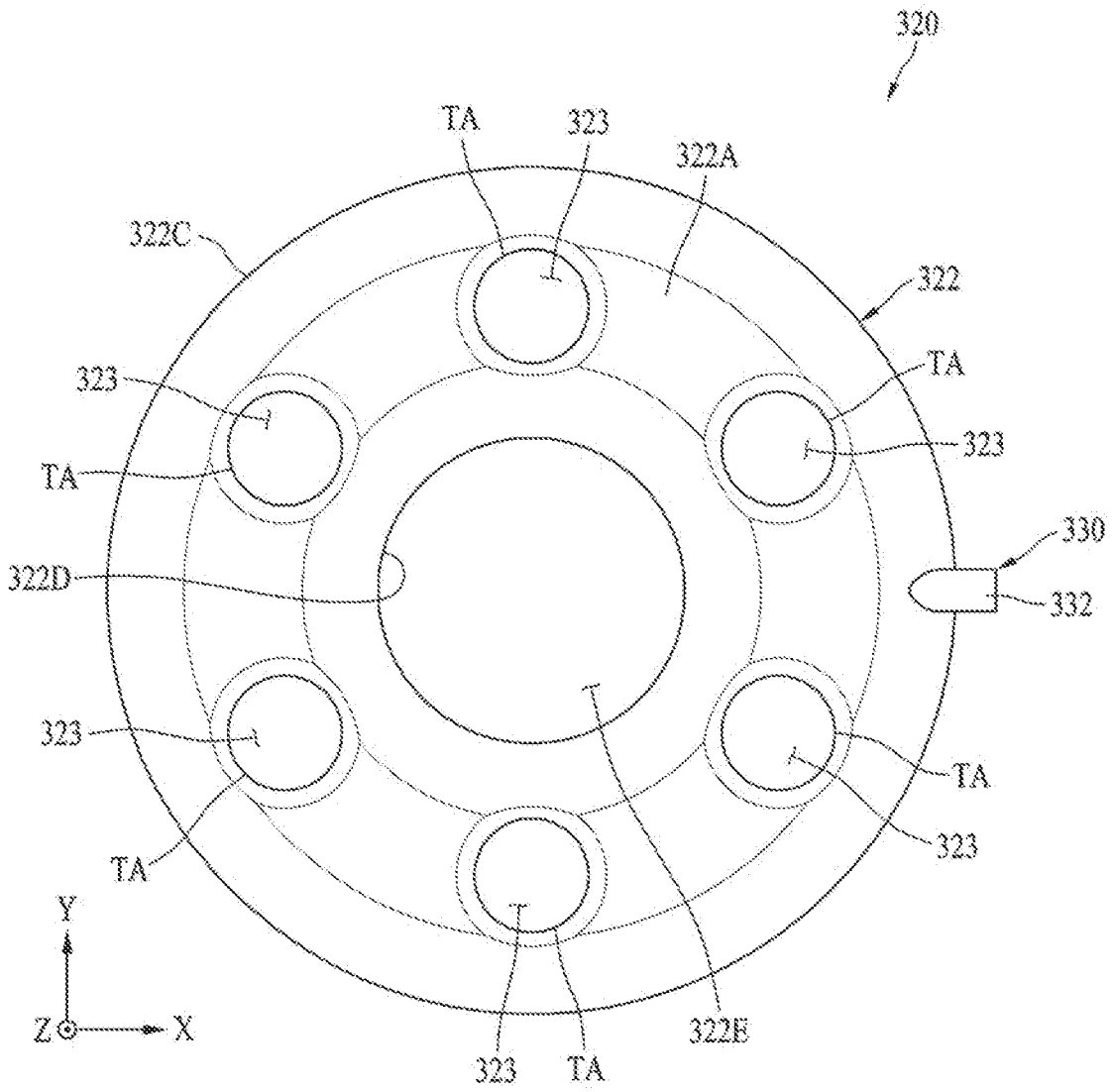
FIG. 4 is a top view of the heat exchanger of FIG. 3.
Figure 5:
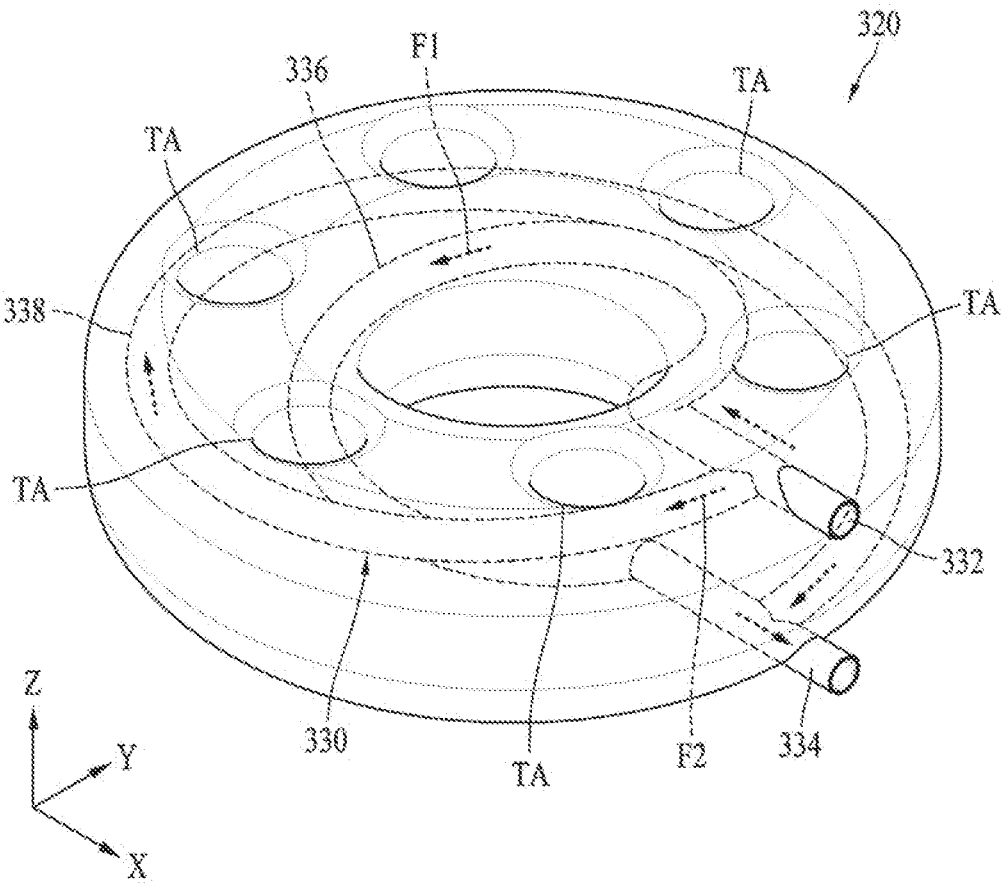
FIG. 5 is a perspective view of an internal structure of the heat exchanger of FIG. 3.

FIG. 3 is a perspective view illustrating an example of a heat exchanger according to an example embodiment, FIG. 4 is a top view of the heat exchanger of FIG. 3, and FIG. 5 is a perspective view of an internal structure of the heat exchanger of FIG. 3.

Referring to FIGS. 3 to 5, a heat exchanger 320 according to an example embodiment may include a thermal body 322 (e.g., the first thermal body 222 of FIG. 2) and a flow path structure 330 (e.g., the flow path structure 230).

The thermal body 322 may include a first surface 322A (e.g., a top surface), a second surface 322B (e.g., a bottom surface) provided to face in a direction opposite to a facing direction of the first surface 322A, and a first side surface 322C (e.g., an external side surface) between the first surface 322A and the second surface 322B. For example, the thermal body 322 may be formed in a cylindrical shape having a length in a circumferential direction and a height, and having a substantially circular or elliptical cross-section.

In an example embodiment, the thermal body 322 may include a second side surface 322D (e.g., an internal side surface) provided between the first surface 322A and the second surface 322B to face in a direction opposite to a facing direction of the first side surface 322C, and to define a hollow portion 322E.

The thermal body 322 may include a target area TA in which a target for the purpose of heat exchange is provided. The target area TA may be formed in the thermal body 322. The target area TA may include at least one channel 323 formed between the first surface 322A and the second surface 322B and/or between the first side surface 322C and the second side surface 322D. The at least one channel 323 may extend between the first surface 322A and the second surface 322B. For example, the at least one channel 323 may at least partially receive at least one vessel (e.g., the vessels 208 of FIG. 2) configured to contain a target substance for the purpose of heat exchange.

In an example embodiment, the target area TA may include a plurality of the channel 323, for example, six channels. The plurality of the channel 323 may be arranged, for example, along the circumferential direction of the thermal body 322. In some example embodiments, the plurality of the channel 323 may be arranged at substantially equal intervals.

The flow path structure 330 may include an inlet port 332 including an inlet 331, an outlet port 334 including an outlet 333, a first flow path 336 configured to connect to each of the inlet 331 and the outlet 333 and to extend along a first side (e.g., an inner side) of the target area TA, and a second flow path 338 configured to connect to each of the inlet 331 and the outlet 333 and to extend along a second side (e.g., an outer side) of the target area TA.

In an example embodiment, the flow path structure 330 may be topologically designed based on a Eulerian graph. For example, the flow path structure 330 has a structure in which an even number of lines (e.g., the first flow path 336 and the second flow path 338) are connected to all nodes (e.g., the inlet 331 and the outlet 333). As another example, the flow path structure 330 may have a structure in which a number of nodes (e.g., the inlet 331 and the outlet 333) at which an odd number of lines (e.g., the first flow path 336, the second flow path 338, and an additional flow path that connects the first flow path 336, and the second flow path 338) are connected is only two.

The flow path structure 330 topologically designed based on the Eulerian graph may have a simple connection structure of flow paths, and a pressure loss (e.g., a pressure drop due to resistance) of the fluid flowing through the flow path may decrease. The flow path structure 330 may have unitary openings (e.g., the inlet 331 and the outlet 333) through which the fluid enters and exits and accordingly, may circulate the fluid without an additional flow source (e.g., the flow source 110 of FIG. 1). That is, the flow path structure 330 may circulate the fluid only with a single flow source, may achieve a simple flow path connection structure, and may reduce a fluid resistance. The flow path structure 330 may improve the aforementioned effects according to an increase in a size of the heat exchanger 320 to which the flow path structure 330 is applied.

In an example embodiment, the inlet port 332 and/or the outlet port 334 may protrude from the first side surface 322C. In an example embodiment, the inlet port 332 may be formed in a portion (e.g., an upper portion) adjacent to the first surface 322A on the first side surface 322C, and the outlet port 334 may be formed in a portion (e.g., a lower portion) offset from the inlet port 332 and adjacent to the second surface 322B on the first side surface 322C. In some example embodiments, the inlet port 332 and the outlet port 334 may be arranged substantially in a line along a height direction (e.g., +/−Z direction) of the thermal body 322. In an example embodiment, the inlet port 332 and the outlet port 334 may extend from the first side surface 322C into the thermal body 322.

In an example embodiment, the inlet port 332 may include a single one of the inlet 331 and the outlet port 334 may include a single one of the outlet 333. In an example embodiment, the first flow path 336 and the second flow path 338 may share the inlet 331 and the outlet 333. The first flow path 336 and the second flow path 338 may bifurcate from the inlet port 332 and may join the outlet port 334. In some example embodiments, the first flow path 336 and the second flow path 338 may bifurcate and/or join in the thermal body 322. The fluid that flows through each of the first flow path 336 and the second flow path 338 bifurcating from the inlet 331 may pool into the outlet 333 along a predetermined flow stream without mixing and interfering with each other.

In an example embodiment, a direction in which the first flow path 336 guides the fluid and a direction in which the second flow path 338 guides the fluid may be substantially opposite to each other, at least locally based on the target area TA. For example, a direction of a first flow stream F1 of a portion that extends along a first side (e.g., an inner side) of the target area TA in the first flow path 336 may be a first spiral direction (e.g., a counterclockwise direction when viewed in a −Z axial direction) and a direction of a second flow stream F2 of a portion that extends along a second side (e.g., an outer side) of the target area TA in the second flow path 338 may be a second spiral direction (e.g., a clockwise direction when viewed in the −Z axial direction) opposite to the first spiral direction.

In an example embodiment, the first flow path 336 and the second flow path 338 may form the flow path structure 330, which is three-dimensional. For example, the first flow path 336 may extend in an inner radial direction of the thermal body 322 between a single pair of adjacent ones of the target area TA, may obliquely extend in the first spiral direction with surrounding the inside of the plurality of the target area TA, and may extend in an outer radial direction of the thermal body 322 between the single pair of adjacent ones of the target area TA. The second flow path 338 may bifurcate from the first flow path 336, may surround the outside of the plurality of the target area TA, may obliquely extend in the second spiral direction opposite to the first spiral direction, and may lead to the first flow path 336. The flow path structure 330 formed by the first flow path 336 and the second flow path 338 may reduce or prevent physical interference with respect to each other.

In an example embodiment, the first flow path 336 and the second flow path 338 may be formed in the thermal body 322. The first flow path 336 and the second flow path 338 may extend within the thermal body 322 while approaching the target area TA, thereby increasing a heat exchange area with the target area TA.

In an example embodiment, the first flow path 336 and the second flow path 338 may be at least partially symmetrically formed. For example, a portion that extends along an inner side of the target area TA in the first flow path 336 and a portion that extends along an outer side of the target area TA in the second flow path 338 may be at least locally symmetrical.

In an example embodiment, the first flow stream F1 of the fluid flowing through the first flow path 336 and the second flow stream F2 of the fluid flowing through the second flow path 338 may be in parallel. The fluid may bifurcate into the first flow path 336 and the second flow path 338 and may circulate in symmetrical directions, thereby reducing a temperature deviation between the plurality of the target area TA. Meanwhile, in the case of a comparative embodiment that includes forming a flow path structure 330, that is serial, with only one flow path from among the first flow path 336 and the second flow path 338, when viewed along a flow stream direction (e.g., direction of the first flow stream F1 or the second flow stream F2), a temperature of the fluid flowing through a flow path increases with getting close from a target area TA in which heat exchange is performed first to a target area TA in which heat exchange is performed last and may lead to reduced heat exchange efficiency of the plurality of the target area TA.

In an example embodiment, a flow cross-sectional area of the first flow path 336 may be different from a flow cross-sectional area of the second flow path 338. In another example embodiment, the flow cross-sectional area of the first flow path 336 may be substantially identical to the flow cross-sectional area of the second flow path 338.

Figure 6:
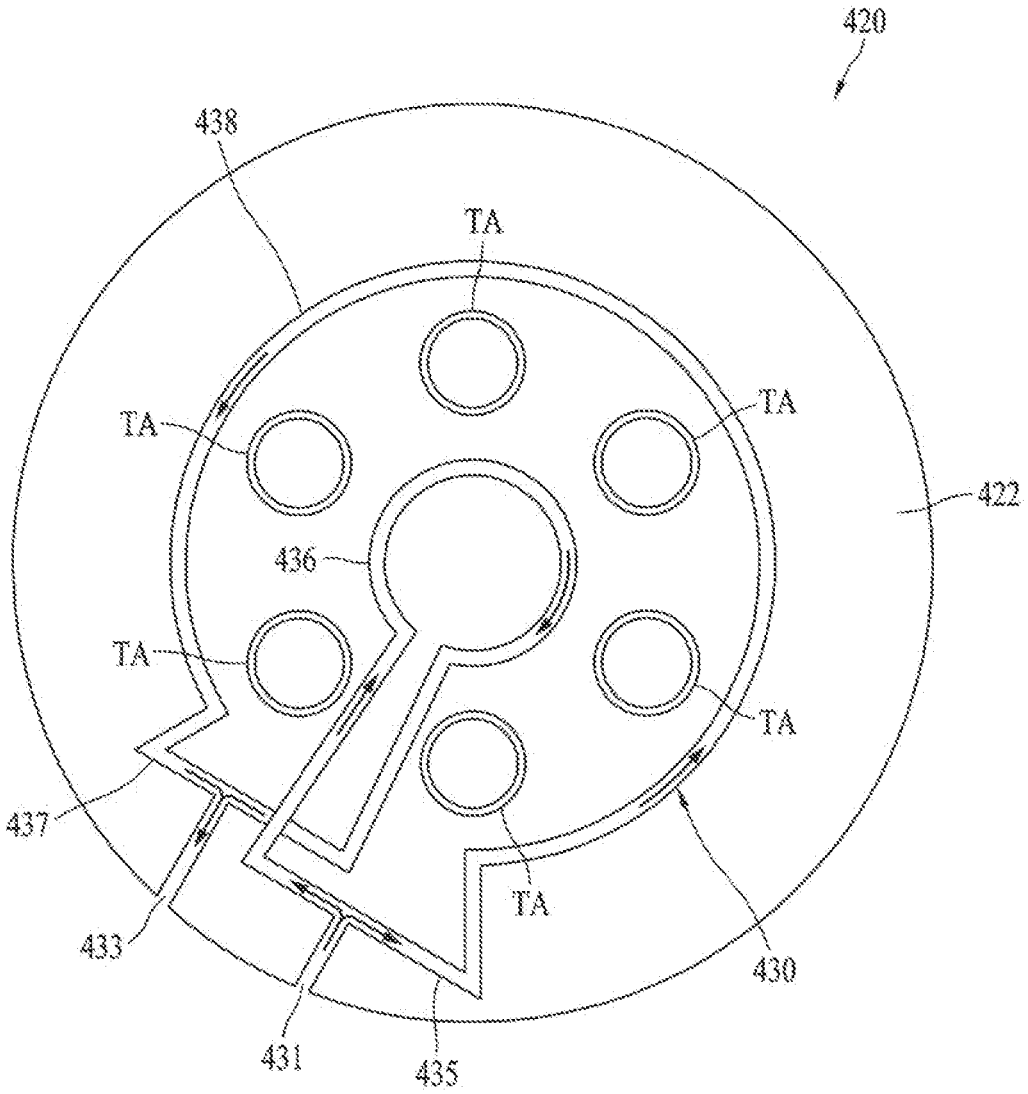
FIG. 6 illustrates another example of a flow path structure of a heat exchanger according to an example embodiment.

FIG. 6 illustrates another example of a flow path structure of a heat exchanger according to an example embodiment.

Referring to FIG. 6, a heat exchanger 420 (e.g., the heat exchanger 320 of FIGS. 3 to 5) may include a thermal body 422 (e.g., the thermal body 322) and the flow path structure 430 (e.g., the flow path structure 330). The flow path structure 430 may include an inlet 431 (e.g., the inlet 331), an outlet 433 (e.g., the outlet 333), a first flow path 436 (e.g., the first flow path 336), and a second flow path 438 (e.g., the second flow path 338).

The flow path structure 430 may include an entrance manifold 435 configured to connect the inlet 431 to the first flow path 436 and the second flow path 438, and an exit manifold 437 configured to connect the first flow path 436 and the second flow path 438 to the outlet 433. In an example embodiment, the entrance manifold 435 and the exit manifold 437 may be formed in the thermal body 422. The entrance manifold 435 and the exit manifold 437 may be provided in the thermal body 422 to not interfere with each other. In another example embodiment, at least one of the entrance manifold 435 and the exit manifold 437 may be formed outside the thermal body 422.

Figure 7:
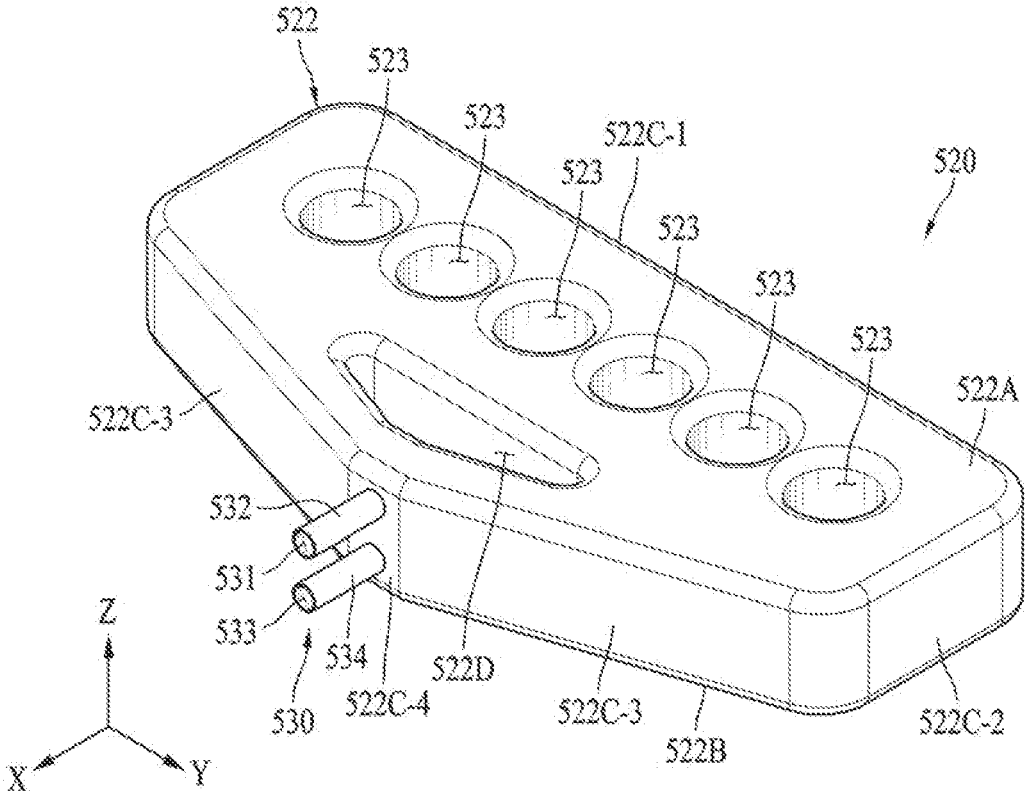
FIG. 7 is a perspective view illustrating another example of a heat exchanger according to an example embodiment.
Figure 8:
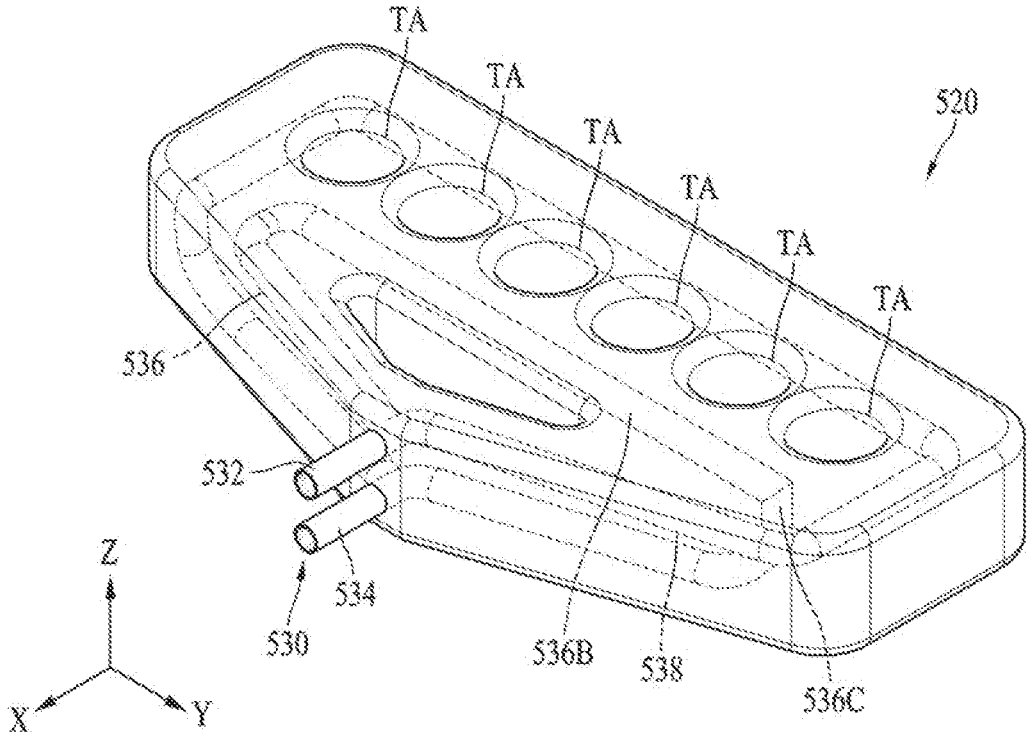
FIG. 8 is a perspective view of an internal structure of the heat exchanger of FIG. 7.
Figure 9:
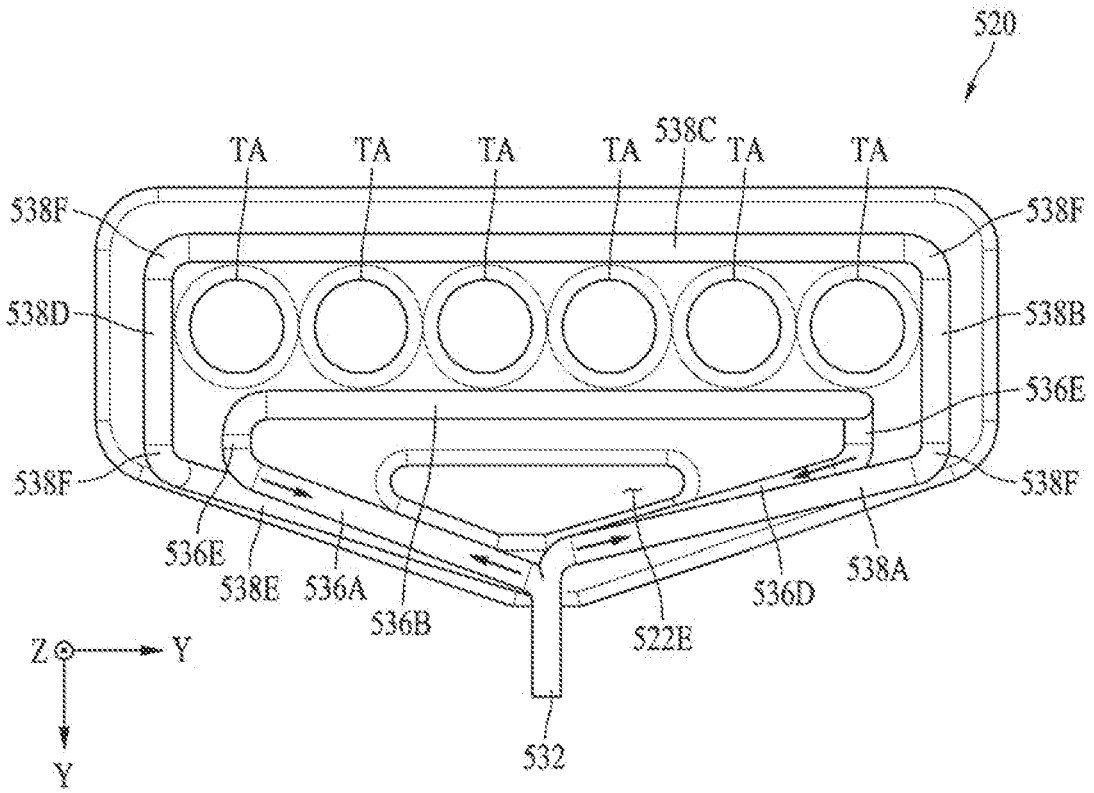
FIG. 9 is a top view of the internal structure of the heat exchanger of FIG. 7.

FIG. 7 is a perspective view illustrating another example of a heat exchanger according to an example embodiment, FIG. 8 is a perspective view of an internal structure of the heat exchanger of FIG. 7, and FIG. 9 is a top view of the internal structure of the heat exchanger of FIG. 7.

Referring to FIGS. 7 to 9, a heat exchanger 520 (e.g., the heat exchanger 320 of FIGS. 3 to 5) according to an example embodiment may include a thermal body 522 (e.g., the thermal body 322) and a flow path structure 530 (e.g., the flow path structure 330).

The thermal body 522 may include a first surface 522A (e.g., the first surface 322A), a second surface 522B (e.g., the second surface 322B), and a first side surface (e.g., the first side surface 322C).

In an example embodiment, the first side surface may include a first side area 522C-1 having a first normal direction (e.g., −X direction) and extending in a first longitudinal direction (e.g., +/−Y direction); a single pair of second side areas 522C-2 having a second normal direction (e.g., +/−Y direction) that intersects the first normal direction, extending in a second longitudinal direction (e.g., +/−X direction), connected to the first side area 522C-1, and opposite to each other; a single pair of third side areas 522C-3 having a third normal direction that intersects each of the first normal direction and the second normal direction, extending in a third longitudinal direction that intersects the first longitudinal direction and the second longitudinal direction, and respectively connected to the single pair of second side areas 522C-2; and a fourth side area 522C-4 connected to the single pair of third side areas 522C-3, having a fourth normal direction (e.g., +X direction), and provided between the single pair of third side areas 522C-3.

In an example embodiment, the thermal body 522 may include a second side surface 522D (e.g., the second side surface 322D) configured to define a hollow portion 522E (e.g., the hollow portion 322E).

In an example embodiment, the thermal body 522 may include a plurality of the target area TA configured as a plurality of (e.g., six) channels 523 (e.g., channel 323). The plurality of channels 523 may be arranged in the first longitudinal direction (e.g., +/−Y direction) from each other. In some example embodiments, the plurality of channels 523 may be arranged in substantially a single line. The serial arrangement structure of the plurality of channels 523 may cause internal temperature of a plurality of vessels received in the plurality of channels 523, respectively, to be substantially uniform and may induce constant heat exchange between vessels at different positions.

The flow path structure 530 may include an inlet port 532 (e.g., the inlet port 332) including the inlet 531 (e.g., the inlet 331), an outlet port 534 (e.g., the outlet port 334) including an outlet 533 (e.g., an outlet 333), a first flow path 536 (e.g., the first flow path 336), and a second flow path 538 (e.g., the second flow path 338).

In an example embodiment, the first flow path 536 may include a first extender 536A configured to connect to the inlet port 532 and configured to extend along one of the third side areas 522C-3; a second extender 536B configured to be at a first side (e.g., an inner side) of the plurality of the target area TA, between the plurality of the target area TA and the hollow portion 522E, and configured to extend in the first longitudinal direction (e.g., +/−Y direction); a third extender 536C configured to connect to the second extender 536B, to be adjacent to a single target area TA, and to extend in a height direction (e.g., +/−Z direction) of the thermal body 522; a fourth extender 536D configured to extend along the other one of the third side areas 522C-3, between the other one of the third side areas 522C-3 and the hollow portion 522E, and to connect to the outlet port 534; and a plurality of first connectors 536E each configured to connect a single pair of adjacent extenders among the first extender 536A, the second extender 536B, the third extender 536C, and the fourth extender 536D.

In an example embodiment, the second flow path 538 may include a fifth extender 538A configured to connect to the inlet port 532 and to extend along the other one of the third side areas 522C-3; a sixth extender 538B configured to be adjacent to a single target area TA and to extend in the second longitudinal direction (e.g., +/−X direction) along one of the second side areas 522C-2; a seventh extender 538C configured to be at a second side (e.g., an outer side) of the plurality of the target area TA, between the plurality of target areas TA and the first side area 522C-1, and to extend in the first longitudinal direction (e.g., +/−Y direction); an eighth extender 538D configured to be adjacent to a single target area TA along the other one of second side areas 522C-2 and to extend in the second longitudinal direction (e.g., +/−X direction); a ninth extender 538E configured to extend along the one of the third side areas 522C-3, between the one of the third side areas 522C-3 and the hollow portion 522E, and to connect to the outlet port 534; and a plurality of second connectors 538F each configured to connect a single pair of extenders among the fifth extender 538A, the sixth extender 538B, the seventh extender 538C, the eighth extender 538D, and the ninth extender 538E.

Figure 10:
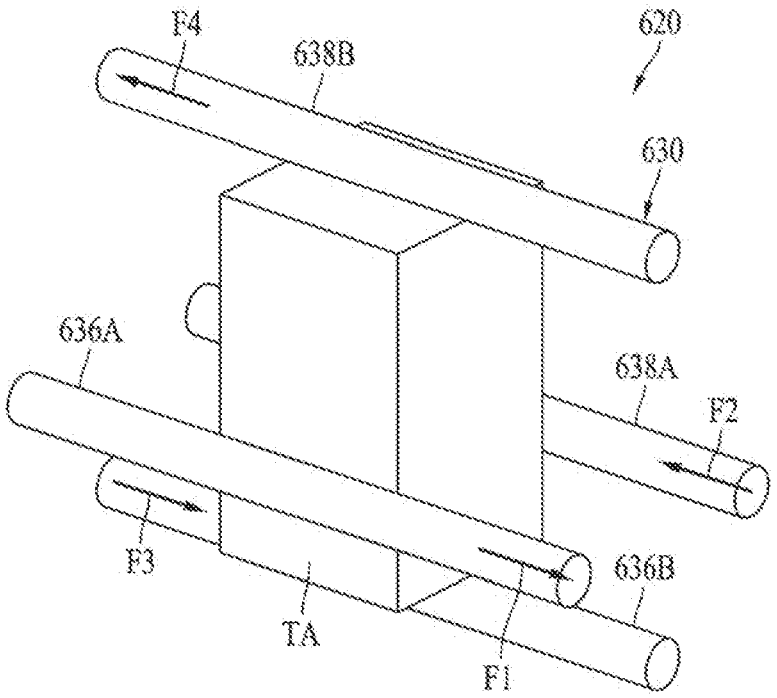
FIG. 10 illustrates another example of a flow path structure of a heat exchanger according to an example embodiment.

FIG. 10 illustrates another example of a flow path structure of a heat exchanger according to an example embodiment.

Referring to FIG. 10, a heat exchanger 620 (e.g., the heat exchanger 320 of FIGS. 3 to 5) according to an example embodiment may include a flow path structure 630 (e.g., the flow path structure 330).

The flow path structure 630 may include a first flow path 636A configured to be at a first side (e.g., an inner side) of a target area TA and to guide a first flow stream F1 of the fluid in a first direction (e.g., a right direction in FIG. 10); a second flow path 638A configured to be at a second side (e.g., an outer side) opposite to the first side of the target area TA and to guide a second flow stream F2 of the fluid in a second direction (e.g., a left direction in FIG. 10) opposite to the first direction; a third flow path 636B configured to be at a third side (e.g., a lower side) between the first side and the second side of the target area TA and to guide a third flow stream F3 of the fluid in the first direction; and a fourth flow path 638B configured to be at a fourth side (e.g., an upper side) opposite to the third side of the target area TA and to guide a fourth flow stream F4 of the fluid in the second direction.

The first flow path 636A, the second flow path 638A, the third flow path 636B, and the fourth flow path 638B may bifurcate from an inlet (e.g., the inlet 331 of FIGS. 3 to 5) and be arranged in parallel and symmetrically provided based on the target area TA. The first flow path 636A and the second flow path 638A may be configured to guide the fluid in substantially opposite directions from each other based on the target area TA, and the third flow path 636B and the fourth flow path 638B may be configured to guide the fluid in substantially opposite directions from each other based on the target area TA.

Figure 11:
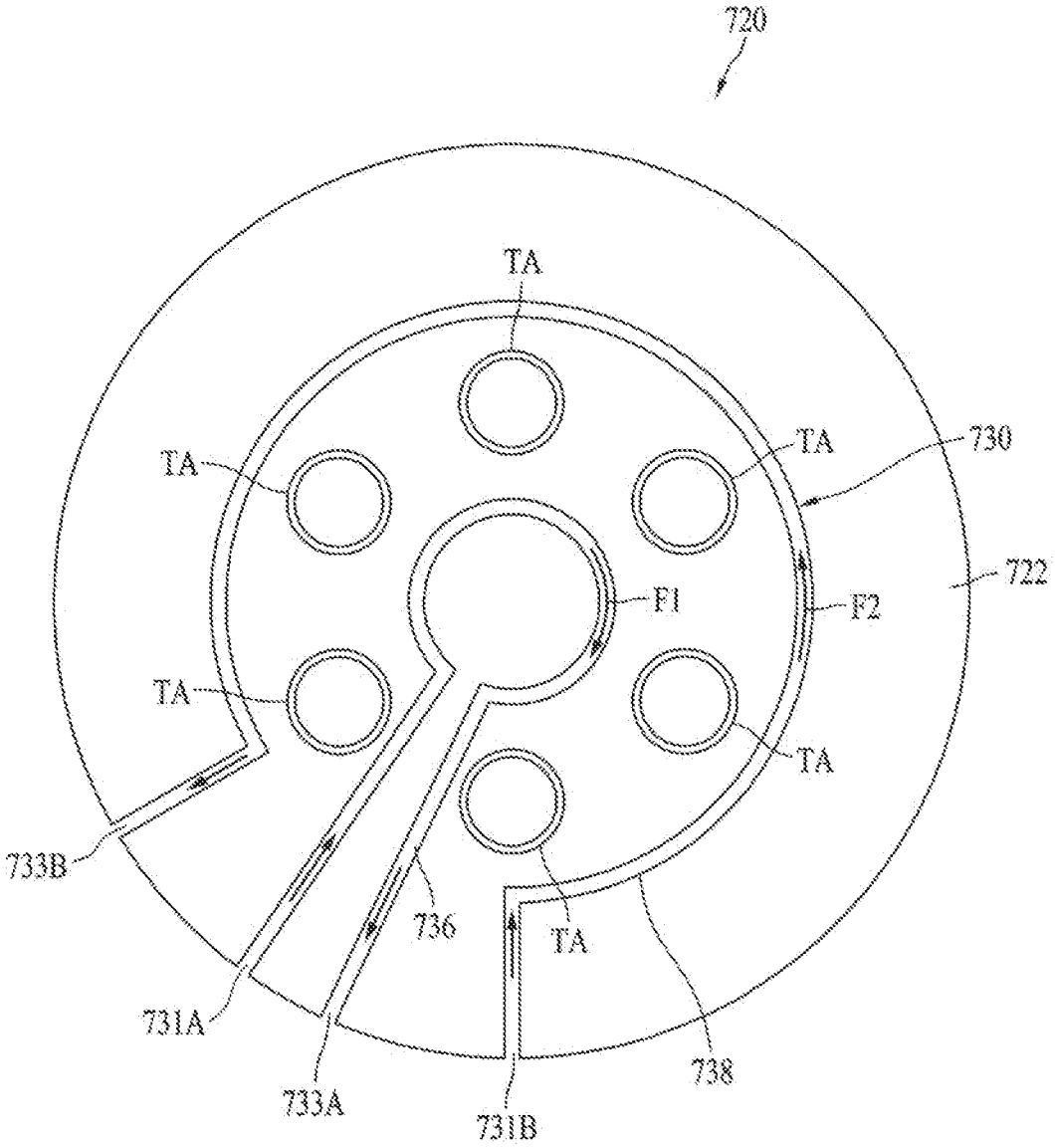
FIG. 11 illustrates another example of a flow path structure of a heat exchanger according to an example embodiment.

FIG. 11 illustrates another example of a flow path structure of a heat exchanger according to an example embodiment.

Referring to FIG. 11, a heat exchanger 720 (e.g., the heat exchanger 320) according to an example embodiment may include a thermal body 722 (e.g., the thermal body 322) including at least one target area TA (e.g., six target areas) and a flow path structure 730 (e.g., the flow path structure 330).

The flow path structure 730 may include a first inlet 731A, a second inlet 731B, a first outlet 733A, and a second outlet 733B. The flow path structure 730 may include a first flow path 736 configured to connect to the first inlet 731A and the first outlet 733A, to extend along a first side (e.g., an inner side) of at least one target area TA, and to guide a first flow stream F1 of the fluid (e.g., a flow stream in a clockwise direction); and a second flow path 738 configured to connect to the second inlet 731B and the second outlet 733B, to extend along a second side (e.g., an outer side) of at least one target area TA, and to guide a second flow stream F2 of the fluid (e.g., a flow stream in a counterclockwise direction).

The flow path structure 730 may be designed based on a Eulerian graph. From a point of view of a heat exchanging system (e.g., the heat exchanging system 10 of FIG. 1) to which the heat exchanger 720 is applied, the first inlet 731A and the second inlet 731B may be connected to a flow source (e.g., the flow source 110) and the first outlet 733A and the second outlet 733B may also be connected to the flow source. From a perspective of the overall flow path circulation circuit, the flow source functions as a single node and an even number of (e.g., four) flow paths are connected to the flow source. Therefore, the flow path structure 730 may at least partially form a structure of the flow path designed based on the Eulerian graph.

Figure 12:
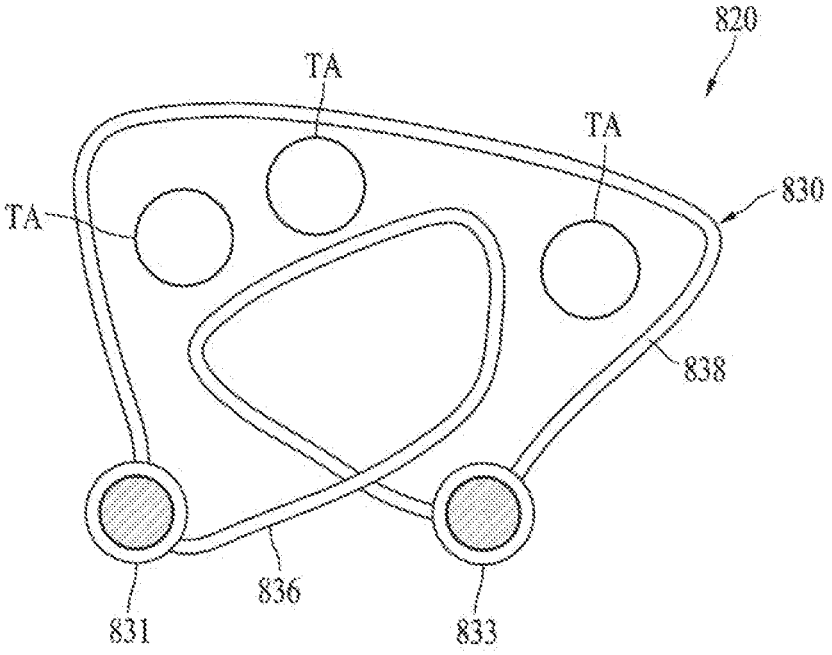
FIG. 12 illustrates another example of a flow path structure of a heat exchanger according to an example embodiment.

FIG. 12 illustrates another example of a flow path structure of a heat exchanger according to an example embodiment.

Referring to FIG. 12, a heat exchanger 820 according to an example embodiment may include a plurality of the target area TA and a flow path structure 830. The flow path structure 830 may include an inlet 831, an outlet 833, a first flow path 836 configured to connect to the inlet 831 and the outlet 833 and to at least partially extend along a first side (e.g., an inner side) of the plurality of target areas TA, and a second flow path 838 configured to connect to the inlet 831 and the outlet 833 and to at least partially extend along a second side (e.g., an outer side) of the plurality of target areas TA.

Figure 13:
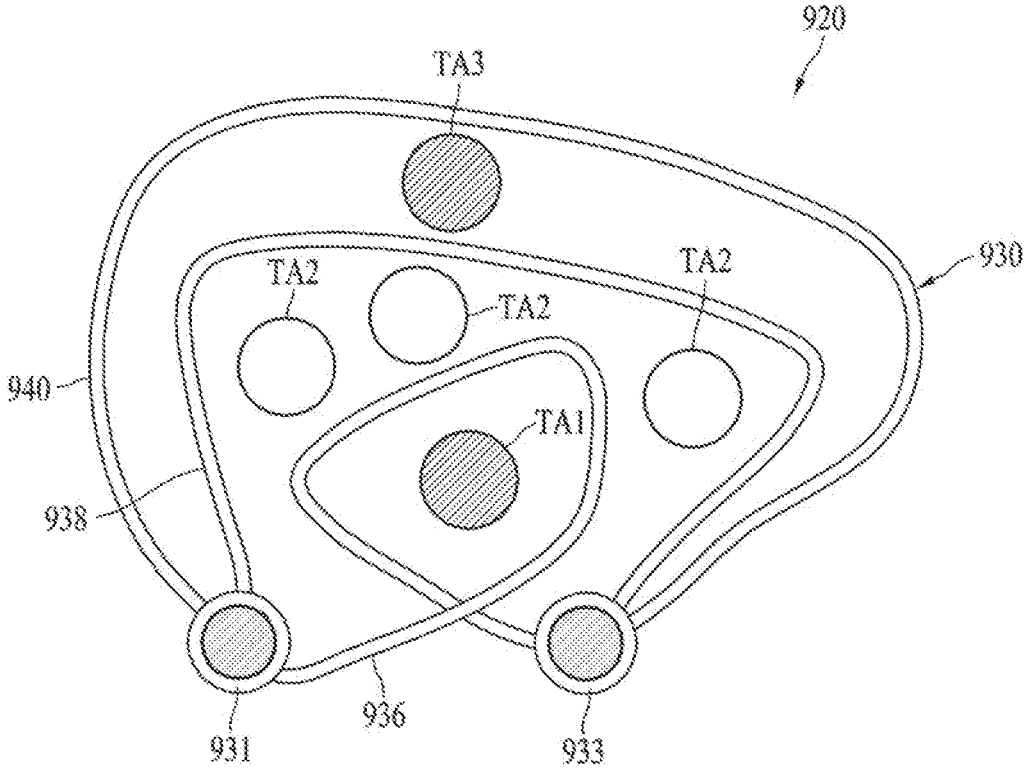
FIG. 13 illustrates another example of a flow path structure of a heat exchanger according to an example embodiment.

FIG. 13 illustrates another example of a flow path structure of a heat exchanger according to an example embodiment.

Referring to FIG. 13, a heat exchanger 920 may include a plurality of target areas (e.g., a first target area TA1, a second target area TA2, and a third target area TA3) and a flow path structure 930. The flow path structure 930 may include an inlet 931; an outlet 933; a first flow path 936 configured to connect to the inlet 931 and the outlet 933 and to substantially surround at least one first target area TA1 and to at least partially extend along an inner side of a plurality of the second target area TA2; a second flow path 938 configured to connect to the inlet 931 and the outlet 933, to at least partially extend along an outer side of the plurality of the second target area TA2, and to at least partially extend along an inner side of at least one third target area TA3; and a third flow path 940 configured to connect to the inlet 931 and the outlet 933 and to at least partially extend along an outer side of at least one third target area TA3.

Figure 14:
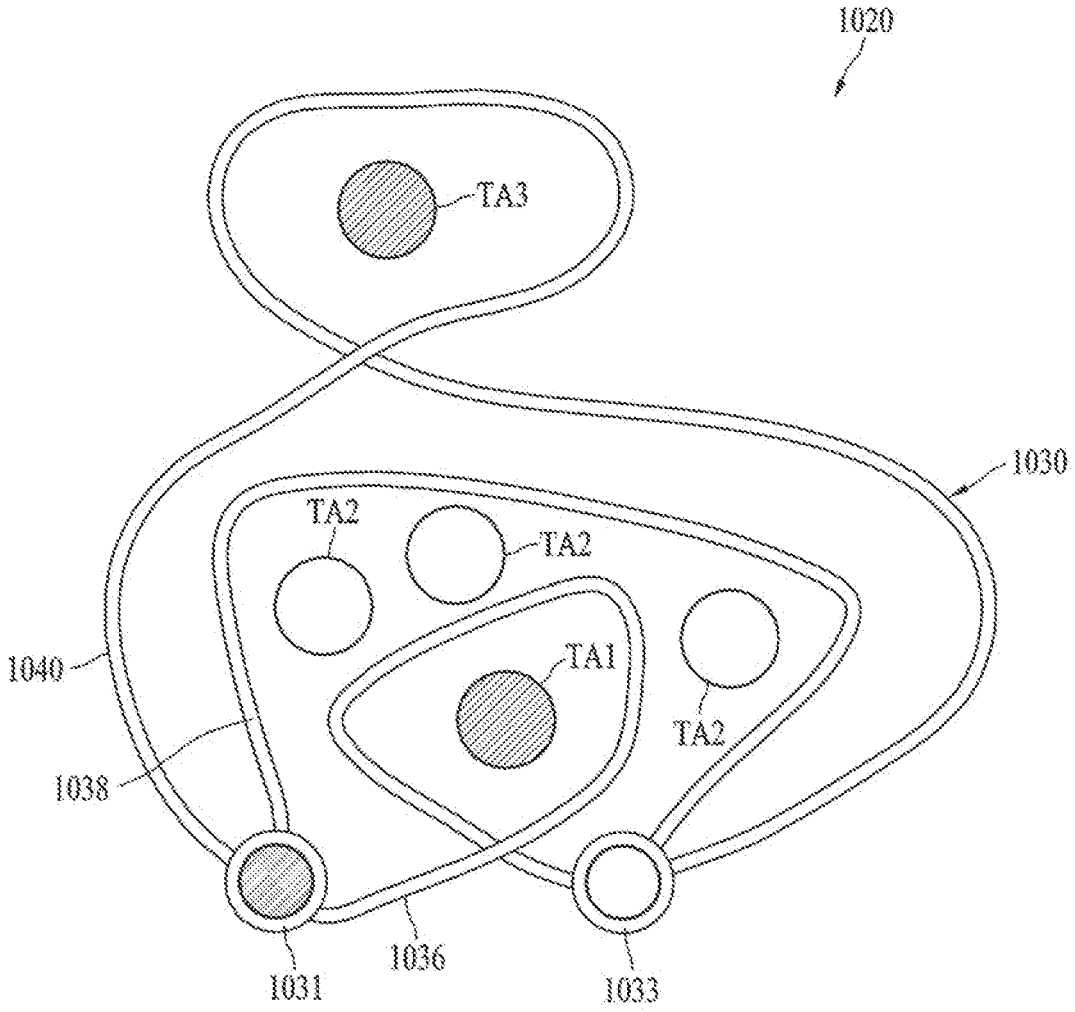
FIG. 14 illustrates another example of a flow path structure of a heat exchanger according to an example embodiment.

FIG. 14 illustrates another example of a flow path structure of a heat exchanger according to an example embodiment.

Referring to FIG. 14, a heat exchanger 1020 according to an example embodiment may include a plurality of target areas (e.g., a first target area TA1, a second target area TA2, and a third target area TA3) and a flow path structure 1030. The flow path structure 1030 may include an inlet 1031; an outlet 1033; a first flow path 1036 configured to connect to the inlet 1031 and the outlet 1033, to substantially surround at least one first target area TA1, and to at least partially extend along an inner side of a plurality of a second target area TA2; a second flow path 1038 configured to connect to the inlet 1031 and the outlet 1033 and to at least partially extend along an outer side of the plurality of the second target area TA2; and a third flow path 1040 configured to connect to the inlet 1031 and the outlet 1033 and to substantially surround at least one third target area TA3.

Figure 15:
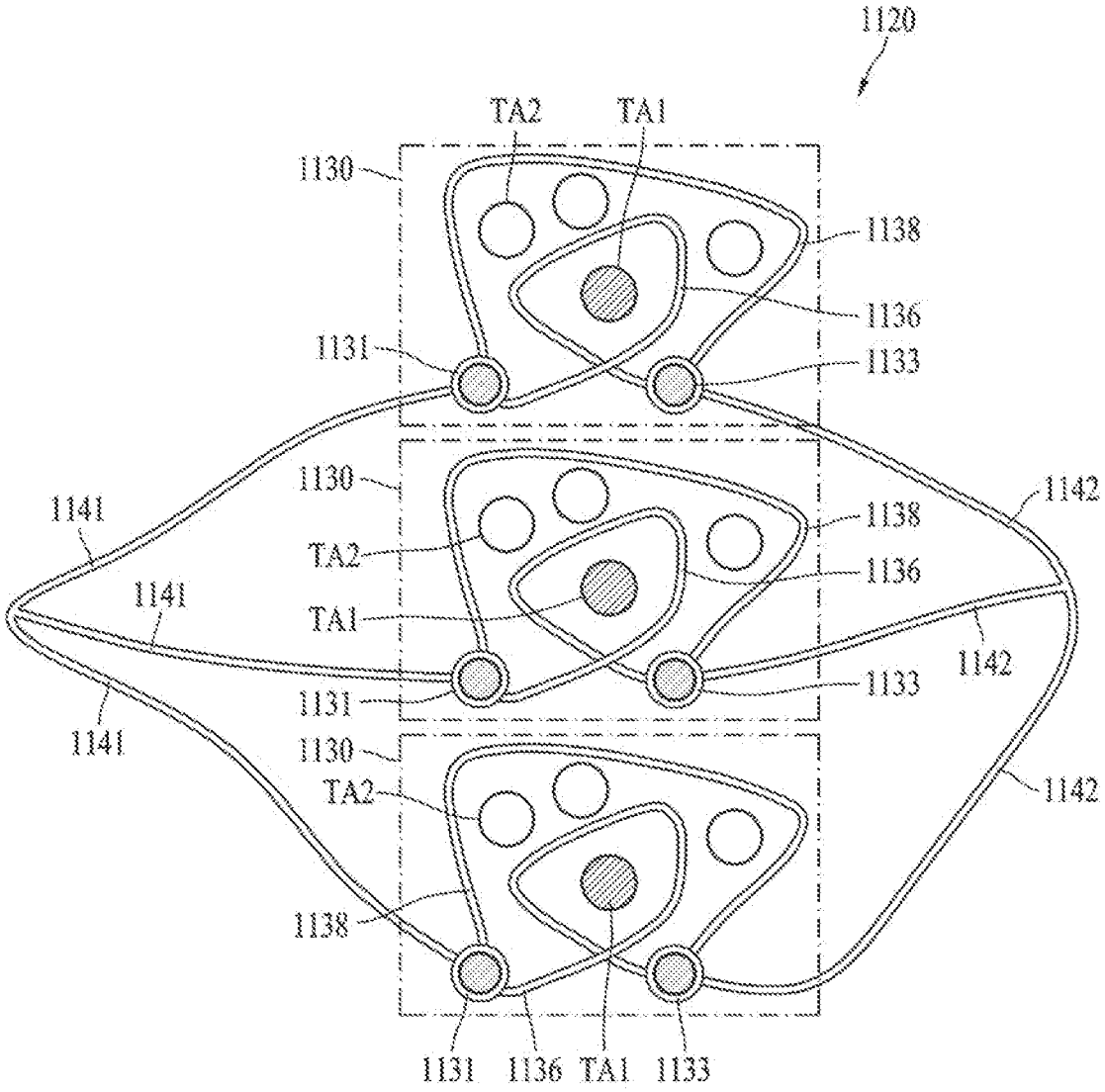
FIG. 15 illustrates another example of a flow path structure of a heat exchanger according to an example embodiment.

FIG. 15 illustrates another example of a flow path structure of a heat exchanger according to an example embodiment.

Referring to FIG. 15, a heat exchanger 1120 according to an example embodiment may include a plurality of target areas (e.g., a first target area TA1 and a second target area TA2) and a plurality of flow path structures 1130. Each of the plurality of flow path structures 1130 may include an inlet 1131; an outlet 1133; a first flow path 1136 configured to connect to the inlet 1131 and the outlet 1133, to substantially surround at least one first target area TA1, and to at least partially extend along an inner side of a plurality of a second target area TA2; and a second flow path 1138 configured to connect to the inlet 1131 and the outlet 1133 and to at least partially extend along an outer side of the plurality of the second target area TA2. The heat exchanger 1120 may include a first connection flow path 1141 configured to connect the plurality of the inlet 1131 of the plurality of flow path structures 1130, and a second connection flow path 1142 configured to connect the plurality of the outlet 1133 of the plurality of flow path structures 1130.

While non-limiting example embodiments are described with reference to the drawings, it will be apparent to one of ordinary skill in the art that various changes and modifications in form and details may be made in these example embodiments without departing from the spirit and scope of the present disclosure. For example, suitable results may be achieved if the described techniques are performed in a different order, and/or if components in a described system, architecture, device, or circuit are combined in a different manner and/or replaced or supplemented by other components or their equivalents. Therefore, the scope of the present disclosure includes all variations of the example embodiments and their equivalents.

What is claimed is:

1. A heat exchanger comprising:

a target area that is a target for heat exchange; and a flow path structure comprising:

at least one inlet;

at least one outlet;

a first flow path connected to each of the at least one inlet and the at least one outlet, and extending, when viewed from a height direction, in two perpendicular first directions in a plane, that are perpendicular to the height direction, along a first side of the target area within the plane; and a second flow path connected to each of the at least one inlet and the at least one outlet, and extending, when viewed from the height direction, in at least one second direction in the plane, along a second side, different from the first side, of the target area within the plane, wherein the target area comprises a plurality of channels arranged with respect to each other in the plane, each of the plurality of channels extending in the height direction that is perpendicular to the plane, and wherein the first flow path extends, when viewed from the height direction, in the two perpendicular first directions and a third direction, opposite to one of the two perpendicular first directions, such that the first flow path at least partially surrounds the plurality of channels and the second flow path in the two perpendicular first directions and a fourth direction, opposite to the other of the two perpendicular first directions.

2. The heat exchanger of claim 1, wherein a direction in which the first flow path is configured to guide a first portion of a fluid is opposite, with respect to the target area, to a direction in which the second flow path is configured to guide a second portion of the fluid.

3. The heat exchanger of claim 1, wherein the first flow path and the second flow path are not directly connected to each other.

4. The heat exchanger of claim 3, wherein each of the first flow path and the second flow path is inclined with respect to the target area.

5. The heat exchanger of claim 1, further comprising:

a thermal body comprising the target area, wherein the first flow path and the second flow path are formed in the thermal body.

6. The heat exchanger of claim 1, wherein a portion of the first flow path that extends along the first side of the target area is symmetrical with respect to a portion of the second flow path that extends along the second side of the target area.

7. The heat exchanger of claim 1, wherein the first flow path forms a first flow stream of a fluid from the at least one inlet to the at least one outlet, and the second flow path forms a second flow stream of the fluid from the at least one inlet to the at least one outlet.

8. The heat exchanger of claim 1, further comprising:

a thermal body comprising the target area, wherein the target area comprises the plurality of channels, and the plurality of channels are arranged, in the thermal body, with respect to each other in a circumferential direction of the thermal body, that is perpendicular to the height direction, each of the plurality of channels extending in the height direction that is perpendicular to the circumferential direction.

9. The heat exchanger of claim 1, further comprising:

a thermal body comprising the target area, wherein the thermal body comprises at least one inlet port comprising the at least one inlet and at least one outlet port comprising the at least one outlet.

10. The heat exchanger of claim 9, wherein the at least one inlet port is within a first portion of the thermal body, and the at least one outlet port is within a second portion of the thermal body that is offset from the first portion in the height direction.

11. The heat exchanger of claim 9, wherein the at least one inlet port and the at least one outlet port protrude from the thermal body.

12. The heat exchanger of claim 9, wherein the first flow path and the second flow path, that are within the thermal body, bifurcate from the at least one inlet port and lead to the at least one outlet port.

13. The heat exchanger of claim 1, wherein a cross-sectional area of the first flow path is different from a cross-sectional area of the second flow path.

14. The heat exchanger of claim 1, further comprising:

a thermal body comprising the target area, wherein the target area comprises the plurality of channels, and the plurality of channels are arranged, in the thermal body, with respect to each other in a first longitudinal direction of the thermal body, that is perpendicular to the height direction, each of the plurality of channels extending in the height direction that is perpendicular to the first longitudinal direction.

15. The heat exchanger of claim 1, wherein the flow path structure further comprises:

an entrance manifold that connects the at least one inlet to the first flow path and the second flow path; and an exit manifold that connects the first flow path and the second flow path to the at least one outlet.

16. The heat exchanger of claim 1, wherein the flow path structure further comprises:

a third flow path connected to the at least one inlet and the at least one outlet and extends along a third side of the target area that is different from the first side and the second side of the target area; and a fourth flow path connected to the at least one inlet and the at least one outlet and extends along a fourth side of the target area that is different from the first side, the second side, and the third side of the target area.

17. The heat exchanger of claim 1, wherein the at least one inlet is a single inlet and the at least one outlet is a single outlet.

18. The heat exchanger of claim 1, wherein the at least one inlet comprises a first inlet and a second inlet, the at least one outlet comprises a first outlet and a second outlet, the first flow path is connected to the first inlet and the first outlet, and the second flow path is connected to the second inlet and the second outlet.

19. A heat exchanging system comprising:

a flow source; and a heat exchanger comprising:

a target area that is a target for heat exchange; and a flow path structure, wherein the flow path structure comprises:

at least one inlet connected to the flow source;

at least one outlet connected to the flow source;

a first flow path connected to each of the at least one inlet and the at least one outlet, and extends, when viewed from a height direction, in two perpendicular first directions in a plane, that are perpendicular to the height direction, along a first side of the target area within the plane, and a second flow path connected to each of the at least one inlet and the at least one outlet, and extends, when viewed from the height direction, in at least one second direction in the plane, along a second side of the target area, different from the first side of the target area, wherein the target area comprises a plurality of channels arranged with respect to each other in the plane, each of the plurality of channels extending in the height direction that is perpendicular to the plane, and wherein the first flow path extends, when viewed from the height direction, in the two perpendicular first directions and a third direction, opposite to one of the two perpendicular first directions, such that the first flow path at least partially surrounds the plurality of channels and the second flow path in the two perpendicular first directions and a fourth direction, opposite to the other of the two perpendicular first directions.

20. The heat exchanging system of claim 19, wherein the heat exchanger further comprises:

a first thermal body configured to condense the target area; and a second thermal body configured to heat the target area.

* * * * *